United States Patent [19]

Welch

[11] Patent Number: 4,974,840

[45] Date of Patent: Dec. 4, 1990

[54] LOUNGE CHAIR WITH FOOT PEDAL EXERCIZER

[76] Inventor: Bobby J. Welch, 5252 Mulhauser Rd., Hamilton, Ohio 45011

[21] Appl. No.: 409,337

[22] Filed: Sep. 19, 1989

[51] Int. Cl.[5] ..... A63B 21/00

[52] U.S. Cl. ..... 272/134; 272/73; 272/144

[58] Field of Search ..... 272/67, 73, 132, 134, 272/136, 144; 297/19, 118

[56] References Cited

U.S. PATENT DOCUMENTS

| | | | |
|---|---|---|---|
| 3,127,171 | 3/1964 | Noland et al. | 272/134 X |
| 3,848,870 | 11/1974 | Craig . | |
| 3,910,571 | 10/1975 | Stenn . | |
| 3,968,963 | 7/1976 | Sileo . | |
| 4,473,254 | 9/1984 | Selon | 297/118 X |
| 4,534,553 | 8/1985 | Shirley | 272/134 X |
| 4,538,804 | 9/1985 | Zibell . | |
| 4,684,170 | 8/1987 | Colby | 297/19 |
| 4,717,146 | 1/1988 | Nohara . | |
| 4,738,445 | 4/1988 | Lautenschläger | 272/134 X |
| 4,809,976 | 3/1989 | Berger | 272/136 X |
| 4,838,547 | 6/1989 | Sterling | 272/134 |

FOREIGN PATENT DOCUMENTS

| | | | |
|---|---|---|---|
| 2712875 | 9/1978 | Fed. Rep. of Germany | 272/134 |

*Primary Examiner*—Robert Bahr

[57] ABSTRACT

A rotary foot pedal mechanism pivotably mounted on a generally conventional lounge chair for adjustment between an upright operating position extending above the chair and a prone storage position extending within the chair structure. A person reclining on the lounge chair can move his/her leg muscles to operate the foot pedal mechanism.

3 Claims, 1 Drawing Sheet

LOUNGE CHAIR WITH FOOT PEDAL EXERCIZER

BACKGROUND AND SUMMARY OF THE INVENTION

This invention relates to a lounge chair that is equipped with a rotary foot pedal mechanism, such that a person reclining on the lounge chair can at the same time exercise the leg muscles with bicycle-type leg pumping movements. The foot pedal mechanism can be retracted into the lounge chair structure, such that the chair can be used as a standard recliner. Preferably the lounge chair back rest and leg structures are foldable for relatively compact storage of the chair assembly.

Various patents show foot pedal mechanisms associated with articles of furniture, e.g. U.S. Pat. No. 3,848,870 to L. Craig, U.S. Pat. No. 3,910,571 to H. Stenn, U.S. Pat. No. 3,968,963 to R. Sileo, and U.S. Pat. No. 4,717,146 to H. Nohara. U.S. Pat. No. 4,538,804 to J. Zibell shows a foot pedal mechanism associated with a recliner panel, whereby the person can assume a prone position while moving the leg muscles in bicycle-type pumping motions.

I am not aware of any prior instances of rotary foot-pedal mechanisms incorporated into recliner type lounge chairs.

THE DRAWINGS

DESCRIPTION OF A PREFERRED EMBODIMENT OF THE INVENTION

Figure 1:
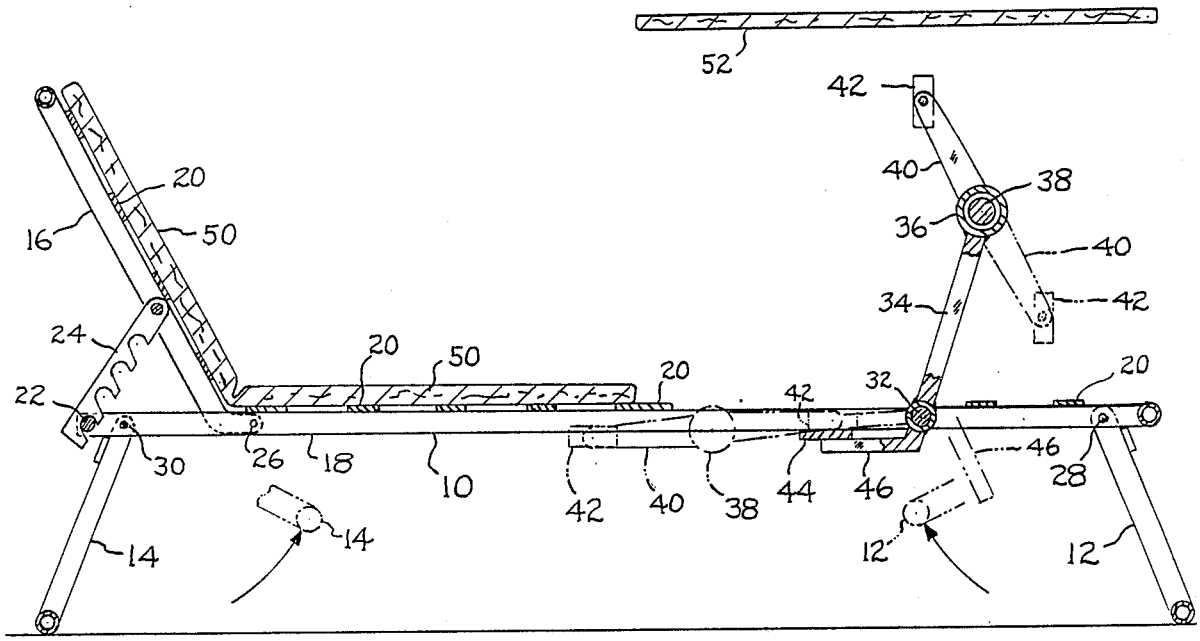
FIG. 1 is a longitudinal sectional view taken through a lounge chair embodying the invention.

The drawings show a foldable lounge chair that includes a horizontal platform 10, front legs 12, rear legs 14, and back rest 16. Platform 10 is of generally conventional construction; it includes a rectangular outer frame 18 and a series of steel (or plastic) bands 20 extending transversely between the longitudinal frame members. The rear end of the frame is defined by a transverse rod 22 that cooperates with notches in struts 24 to support back rest 16 in selected positions extending upwardly and rearwardly from platform 10.

Backrest 16 includes a frame structure having pivot connections 26 with platform 18. Front Legs 12 have pivot connections 28 with platform 18. Rear legs 14 have pivot connections 30 with platform 18. The front and rear legs can thus fold inwardly toward the underface of platform 18, whereas backrest 16 can fold forwardly toward the upper face of platform 18, for compact storage of the chair structure. The chair structure is of generally conventional construction.

My invention relates to a foot pedal mechanism that is carried on chair platform 10 near its front end. The mechanism includes a transverse shaft 32 extending between the longitudinal frame elements of platform 10. An arm structure 34 is swingably mounted on shaft 32 for arcuate movement between a prone storage position (dashed lines) and an upright storage position (full lines); the arm structure includes a short sleeve encircling shaft 32. At its free end arm structure 34 carries a hollow hub structure 36. A second relatively short shaft 38 is rotatably mounted in hub structure 36 so that the ends of the shaft extend beyond the ends of the hub structure.

Shaft 32 is a relatively long shaft having a length on the order of twenty inches, whereas shaft 38 is realtively short (on the order of five inches). Arm structure 34 and shaft 38 are located in the longitudinal mid plane of the chair structure, such that a free space is provided on either side of the arm structure for the legs of a person reclining on the lounge chair. Crank arms 40 extend in opposite directions from opposite ends of shaft 38; one of the crank arms is shown in dashed lines in FIG. 1. A conventional foot pedal 42 is swivably connected to the free end of each crank arm.

Figure 3:
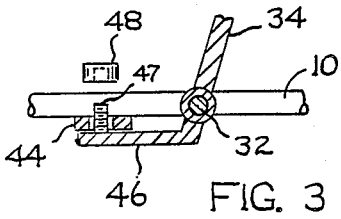
FIG. 3 is a sectional view through a structural detail that can be used as an alternative lock mechanism in the FIG. 1 chair.

The pedal mechanism (defined by arm structure 34, crank arms 40 and pedals 42) has two positions, namely an operating position (full lines) and a storage position (dashed lines). In its operating position the pedal mechanism is stabilized by a stop means that includes a transverse bar 44 extending between the longitudinal frame elements of platform 10. An elongated abutment element 46 extends from arm structure 34 for engagement against the undersurface of bar 44 to limit arcuate motion of arm structure 34 in a clockwise direction. The person's foot pressure on pedals 42 tends to supply a rightward force on arm structure 34, such that abutment element 46 tends to remain in contact with bar 44 without any special locking or latch means. However, a latch means can be provided as insurance, as shown for example in FIG. 3. The latch means there shown includes a stud 47 extended from abutment element 46 through a hole in bar 44; an internally threaded knob 48 is screwed onto the stud to lock (latch) element 46 to bar 44.

Arm structure 34 has an arcuate movement around shaft 32 of about one hundred ten degrees. In its operating position the arm structure extends upwardly and slightly forwardly from platform 10. When the arm structure and associated crank arms 40 are returned to the prone storage position (dashed lines) the arm structure comes to rest against the upper face of transverse bar 44.

The lounge chair in its preferred form includes a semi-soft pad mechanism extending along upper face areas of platform 10 and backrest 16. The pad mechanism includes a first pad 50 extending along the backrest and the rear portion of platform 10. A second pad 52 is adapted to removably extend along the front portion of the platform when the pedal mechanism is in its storage position. Both pads 50 and 52 extend the full transverse width of the chair, typically about twenty two inches.

Figure 2:
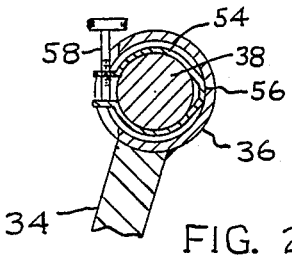
FIG. 2 is an enlarged fragmentary sectional view of a structural detail utilized in the FIG. 1 chair.

FIG. 2 illustrates a friction drag mechanism that can be used to apply a drag resistance to shaft 38. The drag mechanism includes a resilient arcuate band 54 anchored at 56 to an interior surface of hub structure 36. A manually operable screw 58 is threaded through a threaded hole in one end section of the band, to exert a force on the other end section of the band. Manual rotation of screw 58 variably tempers the resilient grip of band 54 on shaft 38, thereby adjusting the drag resistance according to the person's individual wishes. FIG. 2 is representative of various different drag mechanisms that can be used in practice of the invention. The invention is concerned primarily with the pedal mechanism and its pivotal mounting on transverse shaft 32, whereby the pedal mechanism can be easily shifted between an upright operating position and a prone storage position.

I claim:

1. A foldable lounge chair comprising an elongated horizontal platform having a front end and a rear end; front leg means pivotably connected to the platform front end for movement between an upstanding support position and a storage position folded toward the lower face of the platform; rear leg means pivotably connected to the platform rear end for movement between an upstanding support position and a storage position folded toward the lower face of the platform; a backrest pivotably connected to the platform near the platform rear end for movement between an upright position extending angularly upwardly from the platform and a storage position folded toward the upper face of the platform; a first transverse shaft located within the platform near the platform front end; an arm structure swingably mounted on said shaft for arcuate movement between a storage position extending within the platform plane and an operating position extending angularly upwardly from the platform; a hub structure affixed to the free end of said arm structure; a second shaft rotatably mounted in said hub structure; crank arms extending in opposite directions from the ends of said second shaft; a foot pedal carried on the free end of each crank arm; and a stop means for limiting arcuate movement of the arm structure to approximately one hundred ten degrees measured around the axis of the first transverse shaft, whereby the arm structure has an operating position wherein it extends upwardly and forwardly from the first transverse shaft; said stop means comprising a transverse bar (44) carried on the horizontal platform rearwardly from said first transverse shaft; said arm structure including an abutment element (46) extending away from the hub structure for engagement with the undersurface of said transverse bar when said arm structure has reached its operating position.

2. The lounge chair of claim 1 wherein said first transverse shaft is a relatively long shaft extending substantially the entire transverse width of the horizontal platform, said second transverse shaft being a relatively short shaft located on the longitundinal centerline of the platform, whereby the foot pedals are located within the top plan dimensions of the horizontal platform so that a person reclining on the platform can exert foot pressure on the pedals.

3. The lounge chair of claim 1, and further comprising pad means extending along upper face areas of the platform and back rest; said pad means including a first pad extending along the back rest and the rear portion of the horizontal platform, and a second pad adapted to removably extend along the front portion of the platform when said arm structure is in its storage position.

* * * * *